US008389834B2

(12) United States Patent
Murakami

(10) Patent No.: US 8,389,834 B2
(45) Date of Patent: Mar. 5, 2013

(54) KEY DRIVE DEVICE AND KEYBOARD MUSICAL INSTRUMENT

(75) Inventor: Hiroyuki Murakami, Kakegawa (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/343,234

(22) Filed: Jan. 4, 2012

(65) Prior Publication Data

US 2012/0174724 A1 Jul. 12, 2012

(30) Foreign Application Priority Data

Jan. 12, 2011 (JP) ..... 2011-004082

(51) Int. Cl.
*G10C 3/20* (2006.01)

(52) U.S. Cl. ..... 84/244

(58) Field of Classification Search ..... 84/243, 84/244, 174, 245, 246
See application file for complete search history.

(56) References Cited

U.S. PATENT DOCUMENTS 5,527,987 A 6/1996 Yamamoto et al.
2001/0047713 A1 12/2001 Muramatsu et al.
2002/0078816 A1 * 6/2002 Inoue ..... 84/423 R
2004/0025674 A1 2/2004 Muramatsu et al.
2004/0163526 A1 8/2004 Muramatsu
2008/0276789 A1 11/2008 Shimizu

FOREIGN PATENT DOCUMENTS

JP 2004-252302 A 9/2004
WO WO 92/02010 A1 2/1992

OTHER PUBLICATIONS

Extended European Search Report dated Jun. 5, 2012 (seven (7) pages).

* cited by examiner

*Primary Examiner* — Kimberly Lockett
(74) *Attorney, Agent, or Firm* — Crowell & Moring LLP

(57) ABSTRACT

A key drive device to be installed on a musical instrument with a keyboard partly located above a leg block via a key bed, including: drive units to be at least partly inserted into a removal space in the key bed. In a state in which the drive units are installed, at least one drive unit which drives at least one key located above the leg block includes: (a) a first portion at least a part of which is inserted into an insertion space portion of the removal space between the leg block and the keyboard; and (b) a second portion at least a part of which is disposed in other space portion of the removal space, a dimension of the second portion in at least one of a vertical direction and a horizontal short-side direction being larger than that of the first portion.

10 Claims, 15 Drawing Sheets

KEY DRIVE DEVICE AND KEYBOARD MUSICAL INSTRUMENT

CROSS REFERENCE TO RELATED APPLICATION

The present application claims priority from Japanese Patent Application No. 2011-004082, which was filed on Jan. 12, 2011, the disclosure of which is herein incorporated by reference in its entirety.

BACKGROUND OF THE INVENTION

1. Field of the Invention

The present invention relates to a technique of a key drive device configured to drive keys of a keyboard musical instrument.

2. Discussion of Related Art

For permitting an acoustic piano to have an automatic playing or performance function, there has been known a technique of disposing a key drive device (key drive unit) having solenoids for driving keys of a keyboard, in a space formed by cutting a portion of a key bed which is located below the keys. The key drive device is configured to actuate solenoids by control signals in accordance with performance contents, thereby transmitting a drive force to associated keys from undersides thereof in the neighborhood of a rear end portion (nearer to a back check) of each key. As a result, the keys are driven as if a player or performer has depressed the keys, and hammers corresponding to the keys strike associated strings, whereby sounds are generated.

For installing the thus constructed key drive device, it is necessary, because of its installation position, to carry out a large-scale working operation on an acoustic piano. Further, it takes a long time to install the key drive device on the acoustic piano. In view of this, there has been developed a technique of facilitating an installation operation of the key drive device on the acoustic piano, as disclosed in the following Patent Literature 1, for instance.

Patent Literature 1: JP-A-2004-252302

SUMMARY OF THE INVENTION

In some of the acoustic pianos, there exist not only the key bed, but also leg blocks which connect legs and the key bed, below the keys at opposite end portions of the keyboard, from a design viewpoint. In the technique disclosed in the above Patent Literature 1, because the key drive device is not entirely accommodated within the key bed, a portion of the key drive device protrudes downwardly of the key bed. Where the leg blocks exist below the keys via the key bed, the downwardly protruding portion of the key drive device interferes the leg block. Accordingly, it is necessary to remove, by cutting, a part of the leg block prior to installation of the key drive device. Thus, when installing the key drive device on the acoustic piano constructed as described above, the working operation on the acoustic piano takes time, and the external appearance of the piano changes.

The present invention has been made in the light of the situations described above. It is a first object of the invention to provide a key drive device for driving keys to be installed on a keyboard musical instrument in which a part of a keyboard is located above a leg block, without a need of removing a portion of the leg block by cutting. It is a second object to provide a keyboard musical instrument in which the key drive device is installed. It is a third object of the invention to provide a method of installing of a key drive device on a keyboard musical instrument.

The above-indicated first object may be attained by a first aspect of the present invention, which provides a key drive device (10; 10A; 10B) which is to be installed on a keyboard musical instrument (1) configured such that a part of a keyboard (2) is located above a leg block (4) via a key bed (3) and which is configured to drive a plurality of keys (20) of the keyboard in accordance with control signals inputted to the key drive device, comprising:

a plurality of drive units (10-L, 10-U; 10A-L, 10A-U; 10B-L, 10B-U) each of which includes a plurality of actuators (101) for respectively driving the plurality of keys and a control circuit (210) for controlling operations of the plurality of actuators in accordance with the control signals and each of which is to be installed on the keyboard musical instrument such that at least a part of each of the drive units is inserted into a removal space (30) formed by removing a part of the key bed so as to penetrate therethrough in a vertical direction, wherein, in a state in which the plurality of drive units are installed on the keyboard musical instrument, at least one of the drive units which drives at least one of the keys each of which is located above the leg block includes: (a) a first portion (100*b*; 100Ab; 100Bb) at least a part of which is inserted into an insertion space portion (30*b*) of the removal space defined by and between the leg block and the keyboard and which accommodates the actuators; and (b) a second portion (100*a*, 200*a*; 100Aa, 200Aa; 100Ba, 200Ba) at least a part of which is disposed in other space portion (30*a*) of the removal space except for the insertion space portion, without being inserted into the insertion space portion, and which accommodates the actuators and the control circuit, a dimension of the second portion as measured in at least one of a vertical direction and a horizontal short-side direction being made larger than a dimension of the first portion as measured in the at least one of the vertical direction and the horizontal short-side direction.

The above-indicated second object may be attained according to a second aspect of the present invention, which provides a keyboard musical instrument (1), comprising:

a leg block (4);

a keyboard (2) a part of which is located above the leg block;

a key bed (3) in at least a part of which a space is formed and which is disposed at a position below the keyboard and above the leg block; and the key drive device (10; 10A; 10B) constructed as described above, wherein the removal space (30) into which the plurality of drive units of the key drive device are inserted is the space formed in the key bed.

The above-indicated third object may be attained according to a third aspect of the present invention, which provides a method of installing a key drive device (10; 10A; 10B) on a keyboard musical instrument (1) which is configured such that a part of a keyboard (2) is located above a leg block (4) via a key bed (3), wherein the key drive device is configured to drive a plurality of keys (20) of the keyboard and comprises a plurality of drive units (10-L 10-U; 10A-L, 10A-U; 10B-L, 10B-U) each of which includes a plurality of actuators (101) for respectively driving the plurality of keys and a control circuit (210) for controlling operations of the plurality of actuators in accordance with control signals, and wherein a removal space (30) is formed by removing a part of the key bed so as to penetrate therethrough in a vertical direction, the method comprising the steps of:

inserting a part of at least one of the drive units into an insertion space (30*b*) of the removal space defined by and between the leg block and the keyboard, with at least two of the drive units separated from each other, electrically connecting the at least two separated drive units with the part of the at least one of the drive units inserted in the insertion space, and fixing the plurality of drive units to the key bed with the part of the at least one of the drive units inserted in the insertion space.

The reference numerals in the brackets attached to respective constituent elements of the device in the above description correspond to reference numerals used in the following embodiments to identify the respective constituent elements. The reference numerals attached to each constituent element indicates a correspondence between each element and its one example, and each element is not limited to the one example.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

Embodiment

External Appearance of Automatic Player Piano

Figure 1:
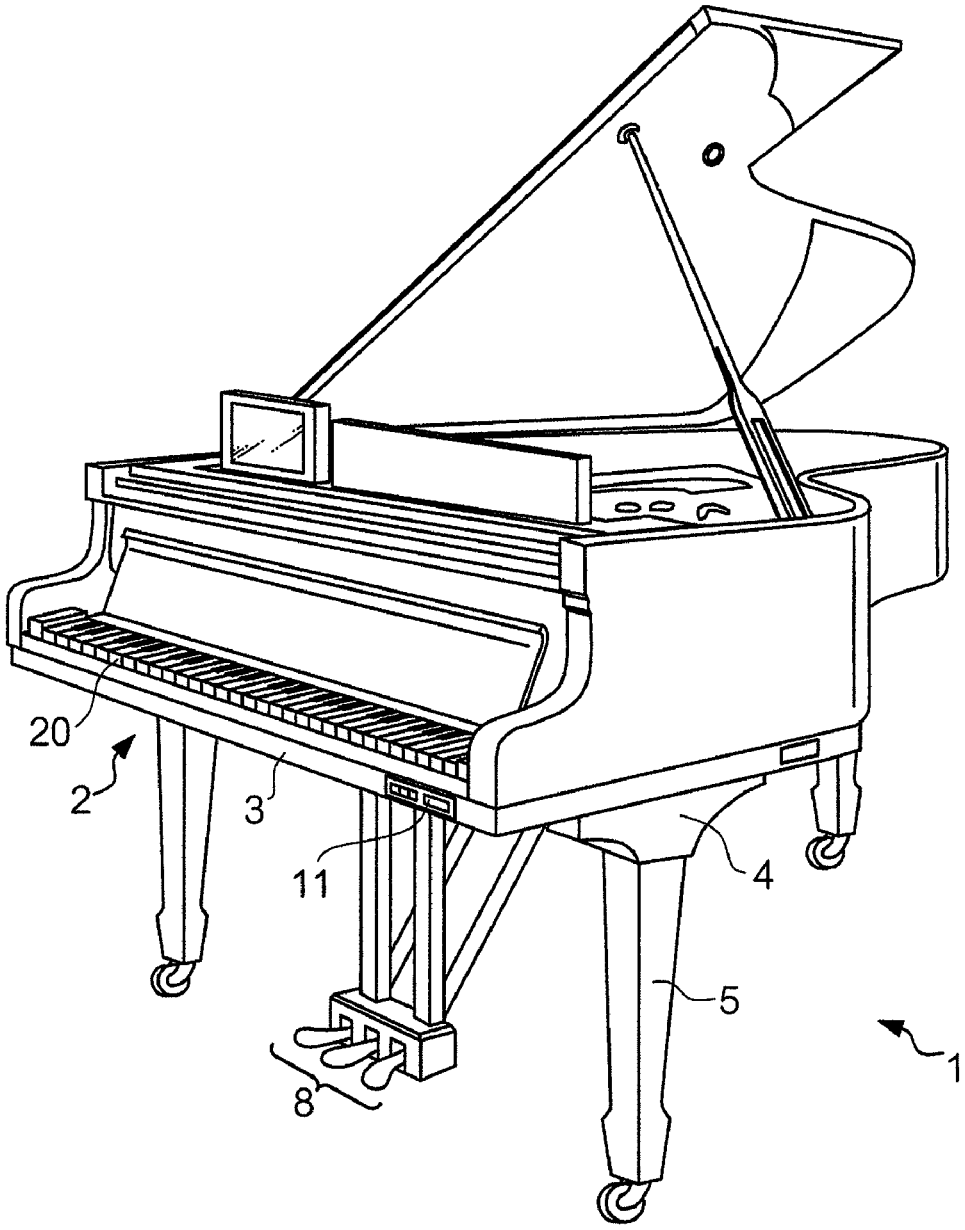
FIG. 1 is a view for explaining an external appearance of an automatic player piano in one embodiment of the present invention.

Referring first to FIG. 1, there will be explained an external appearance of an automatic player piano 1 in one embodiment of the present invention. The automatic player piano 1 has, on its front side, a keyboard 2 in which a plurality of keys 20, e.g., eighty eight keys 20 in the embodiment, are arranged. The automatic player piano 1 further has a key bed 3 located below the keyboard 2, two leg blocks 4 each connecting a corresponding leg portion 5 and the key bed 3, pedals 8, and a controller 11. The leg blocks 4 are located on one and the other of opposite sides of the keyboard 2 in a direction in which the keys 20 are arranged (hereinafter referred to as a "key arrangement direction" where appropriate), namely, at a left-hand end and a right-hand end of the automatic player piano 1. In other words, a part of each of opposite ends of the keyboard 2 in the key arrangement direction is configured to be located above a corresponding leg block 4 via the key bed 3. The automatic player piano 1 is configured such that a key drive device according to one embodiment of the invention is installed on an ordinary grand piano. The keys 20 of the automatic player piano 1 are driven by the key drive device.

The controller 11 includes an arithmetic unit such as a Central Processing Unit (CPU), a Read Only Memory (ROM), a Random Access Memory (RAM), and so on. The controller is configured to obtain performance information in a Musical Instrument Digital Interface (MIDI) format or the like and to output, to the key drive device, control signals for directing driving manners of the keys in accordance with the performance information. The performance information may be inputted through external input terminals or the like, or may be pre-stored in a memory portion or the like.

Figure 2:
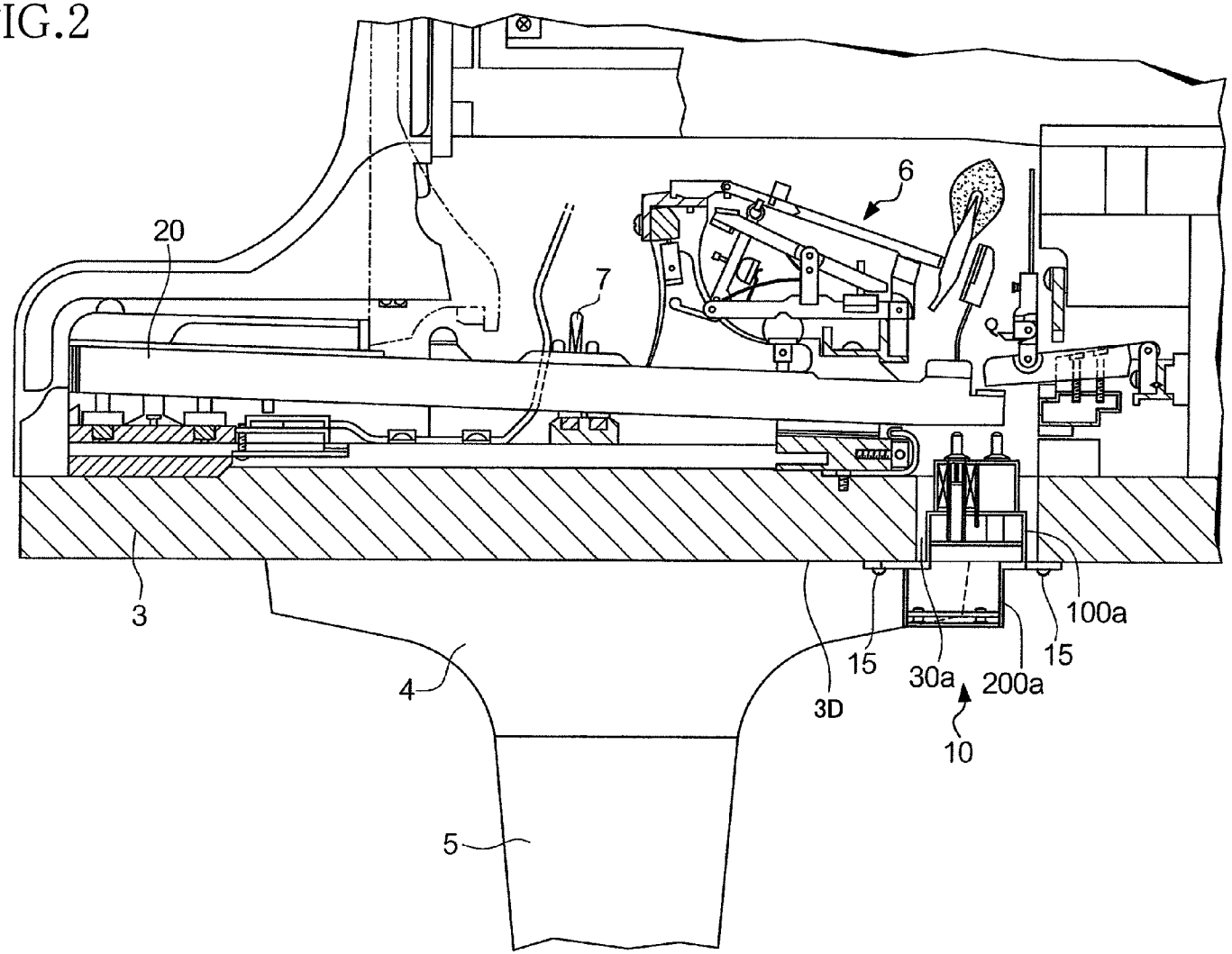
FIG. 2 is a view for explaining a cross-sectional structure of a portion of the automatic player piano in the embodiment of the invention, which portion does not include a leg block.
Figure 3:
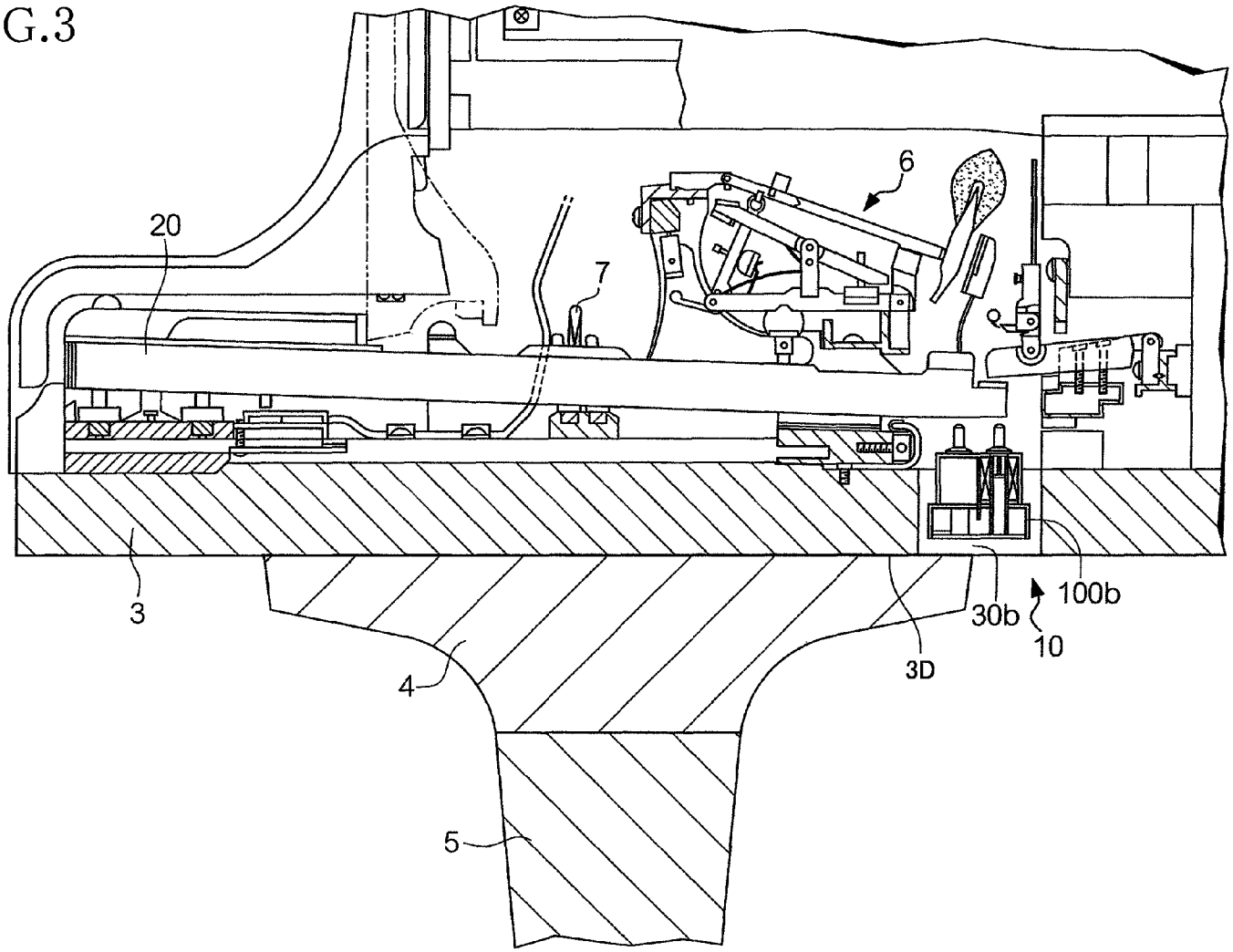
FIG. 3 is a view for explaining a cross-sectional structure of a portion of the automatic player piano in the embodiment of the invention, which portion includes a leg block.
Figure 4:
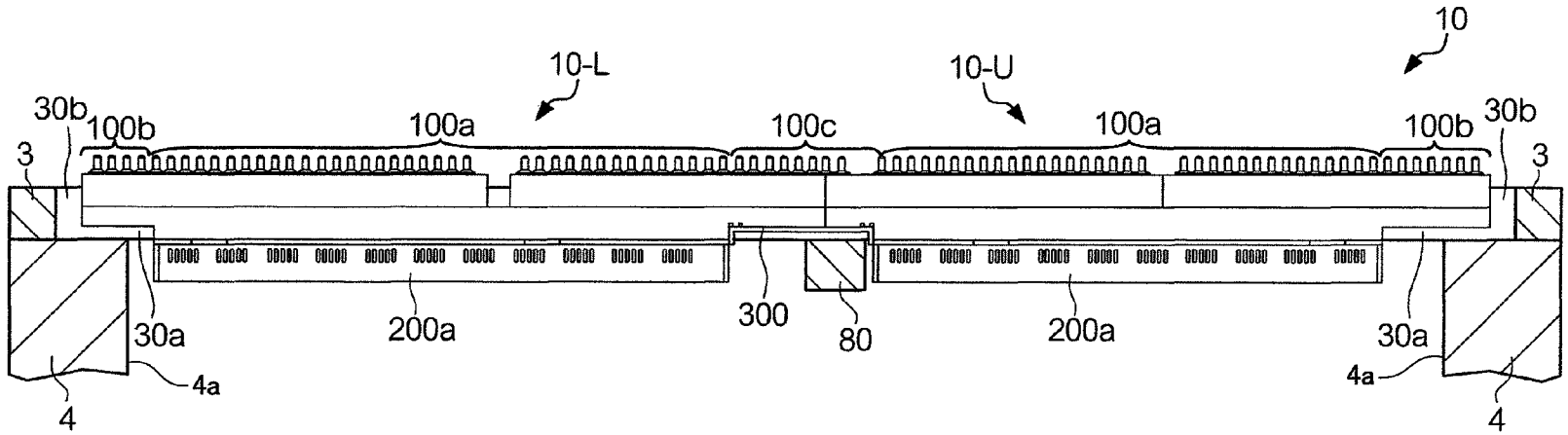
FIG. 4 is a view for explaining a positional relationship among a key bed, the leg blocks, and a key drive device when viewed from a front side of the automatic player piano in the embodiment of the invention.

Referring next to FIGS. 2-4, the location of the key drive device installed on the automatic player piano 1 will be explained.

[Location of Key Drive Device 10]

FIG. 2 is a view for explaining a cross-sectional structure of a portion of the automatic player piano 1 in the embodiment of the invention, which portion does not include the leg block 4. This cross-sectional structure shows a structure of a cross section along a direction in which each key 20 extends (hereinafter referred to as a "key extending direction" where appropriate) when viewed along the key arrangement direction. Each key 20 is rotatably supported by an associated balance pin 7. When a front end portion of the key 20 (i.e., on the side depressed by a performer, namely, on the left side in FIG. 2) is depressed, the key 20 rotates about the balance pin 7 and a rear end portion of the key 20 (which is located on one of opposite sides of the balance pin 7 remote from the front end portion) is raised, whereby an action mechanism 6 corresponding to the key 20 is operated to cause a hammer thereof to strike associated strings. Thus, a sound is generated.

Figure 9:
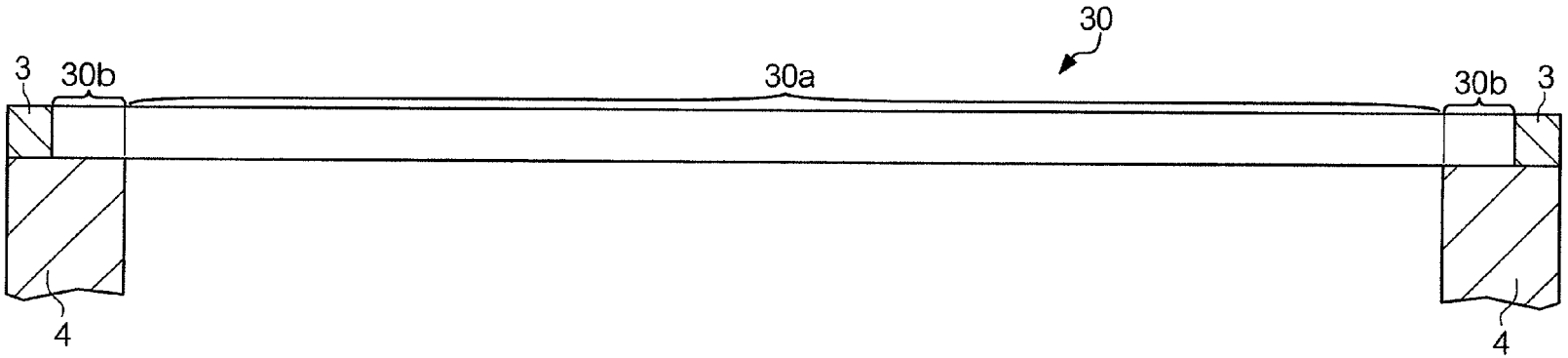
FIG. 9 is a view for explaining an example in which the key drive device of the embodiment of the invention is installed on a grand piano.

The key bed 3 has a space 30*a* formed below the rear end portions of the keys 20. The space 30*a* is formed by cutting, so as to penetrate in the vertical direction, a region which is a part of the key bed 3 and which includes a portion opposing the rear end portions of the keys 20 in the vertical direction. The space 30*a* has a generally rectangular parallelepiped shape extending in the key arrangement direction. In this respect, due to limitations in the working operation for forming the space 30*a*, two cut surfaces that define each of the plurality of corner portions of the space 30*a* may form a curved surface without intersecting at right angles. As shown in FIG. 9, the space 30*a* is a portion of a space 30 (as one example of a removal space) which is formed by removing a part of the key bed 3. More specifically, the space 30 is constituted by spaces 30*b* (each as one example of an insertion space portion) which will be explained later and the space 30*a* (as one example of other space portion) except for the spaces 30*b*. The space 30 is a space formed by removing a part of the key bed 3 and is defined, in the vertical direction, by planes which respectively have the same height levels as an upper surface of the key bed 3 and a lower surface 3D of the key bed 3 and is also defined, in the horizontal direction, by four side surfaces of the space formed by removing a part of the key bed 3. The key drive device 10 includes: a solenoid accommodating portion 100*a* in which are accommodated solenoids 101, each as an actuator for giving a drive force to an associated key 20 so as to drive the key 20; and a circuit-board accommodating portion 200*a* in which is accommodated a circuit board 210 (FIG. 7) having a control circuit for actuating the solenoids 101 on the basis of the controls signals described above. It is noted that the solenoids 101 each as the actuator are not accommodated in the circuit-board accommodating portion 200*a*. The key drive device 10 is fixed to the key bed 3 by being screwed to the lower surface 3D of the key bed 3 by screws 15. In a state in which the key drive device 10 is installed on the automatic player piano 1, a part of the solenoid accommodating portion 100*a* is accommodated in the space 30*a* but an upper end portion of the solenoid accommodating portion 100*a* protrudes upward from the space 30*a*, and the circuit-board accommodating portion 200*a* is disposed so as to be located below the space 30*a*. In the present embodiment, therefore, where the solenoid accommodating portion 100*a* and the circuit-board accommodating portion 200*a* are regarded as one accommodating body (as one example of a second portion) which accommodates the solenoids and the circuit board, a part of the accommodating body is accommodated in the space 30*a* without being inserted in the space 30*b* and a part thereof protrudes downward from the space 30*a*. It is noted that the entirety of the solenoid accommodating portion 100*a* may be accommodated in the space 30*a* or a part of the circuit-board accommodating portion 200*a* may be accommodated in the space 30*a*.

In the key drive device 10, the solenoids are actuated on the basis of the control signals from the controller 11, thereby pushing up the rear end portions of the associated keys 20 to cause the keys 20 to be rotated. Thus, the key drive device 10 realizes an operation similar to that when a performer depresses the front end portions of the keys 20.

FIG. 3 is a view for explaining a cross-sectional structure of a portion of the automatic player piano 1 in the embodiment of the invention, which portion includes the leg block 4. As in FIG. 2, the cross-sectional structure of FIG. 3 shows a structure of a cross section along the direction in the key extending direction when viewed along the key arrangement direction. Unlike the cross-sectional structure of FIG. 2, the leg block 4 exists below the key bed 3 in the cross-sectional structure shown in FIG. 3. The key bed 3 has the spaces 30*b* formed below the rear end portions of the keys 20. Each space 30*b* is formed by cutting, so as to penetrate in the vertical direction, the region which is a part of the key bed 3 and which includes the portion opposing the rear end portions of the keys 20 in the vertical direction. Each space 30*b* has a generally rectangular parallelepiped shape extending in the key arrangement direction. Each space 30*b* differs from the space 30*a* in that the leg block 4 exists below the space 30*b*. Each space 30*b* includes at least a part of a space formed between the keyboard 2 and the corresponding leg block 4. In other words, the leg blocks 4 do not exist below the space 30*a*, and the space 30*a* does not include the space formed between the keyboard 2 and each leg block 4.

The space 30*a* and the spaces 30*b* constitute a continuous space and have a generally rectangular parallelepiped shape as a whole. Hereinafter, the space 30*a* and the spaces 30*b* may be collectively referred to as the space 30.

Figure 7:
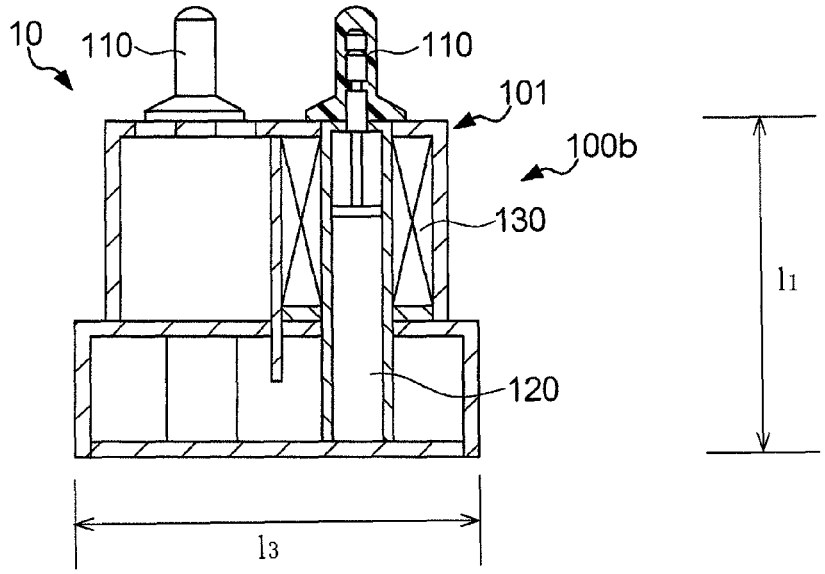
FIG. 7 is a cross-sectional view of the key drive device when viewed along arrows VII-VII in FIG. 6.
Figure 8:
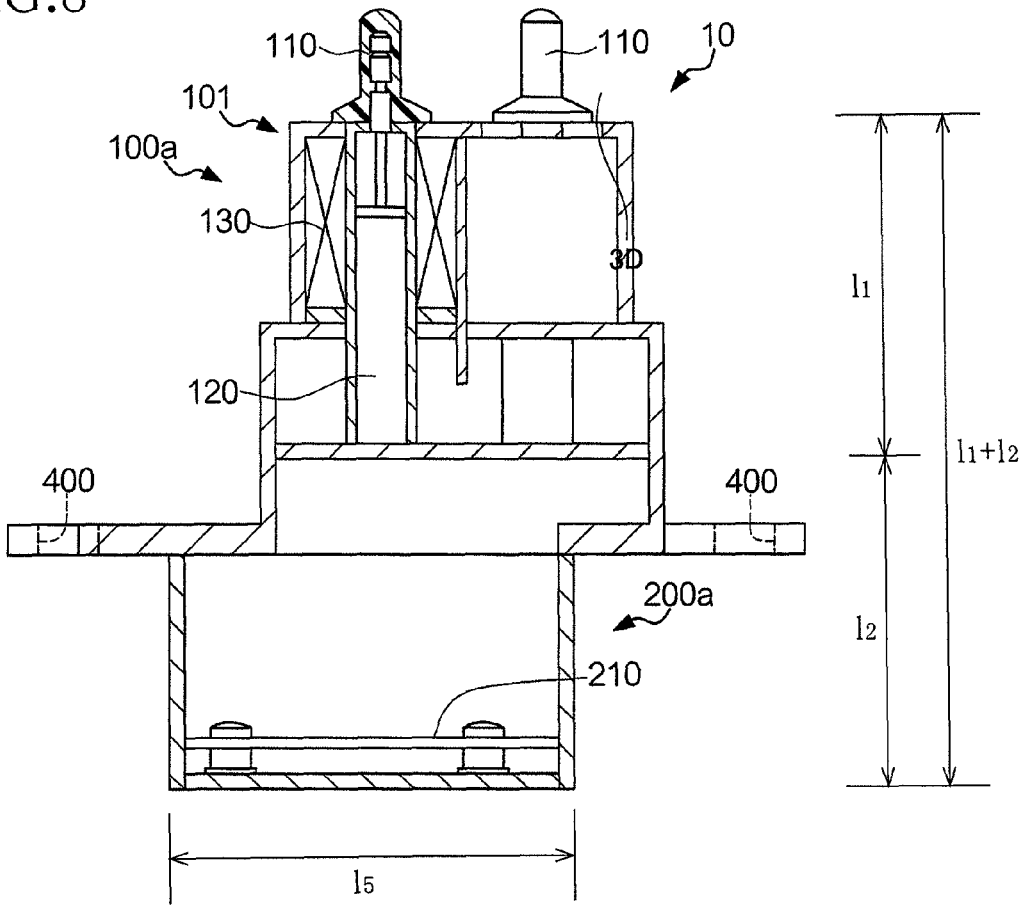
FIG. 8 is a cross-sectional view of the key drive device when viewed along arrows VIII-VIII in FIG. 6.

In the state in which the key drive device 10 is installed on the automatic player piano 1, a portion of the key drive device 10 which is accommodated in the space 30*b* has a solenoid accommodating portion 100*b* (as one example of a first portion) in which the solenoids are accommodated, but the portion does not have a structure corresponding to the circuit-board accommodating portion 200*a* in which is accommodated the circuit board 210 having the control circuit. Further, in the state in which the key drive device 10 is installed on the automatic player piano 1, a part of the solenoid accommodating portion 100*b* is accommodated in the space 30*b*, and the entirety of the solenoid accommodating portion 100*b* is disposed at a height position higher than the lower surface 3D of the key bed 3. Where it is regarded that the lower surface 3D of the key bed 3 and the upper surface of the leg block 4 have the same height level as shown in FIG. 2, the entirety of the solenoid accommodating portion 100*b* is disposed at a height position higher than the upper surface of the leg block 4. The solenoid accommodating portion 100*b* is formed so as to be continuous, in the key arrangement direction, to the solenoid accommodating portion 100*a* which is accommodated in the space 30*a* and is disposed at the same height position as the solenoid accommodating portion 100*a* in the vertical direction. Further, the solenoid accommodating portion 100*b* does not have, at its lower portion, the structure corresponding to the circuit-board accommodating portion 200*a*. While the solenoid accommodating portion 100*b* is not in contact with other constituent members such as the key bed 3 and the leg block 4 in FIG. 3, the solenoid accommodating portion 100*b* has a fixed positional relationship relative to the other constituent members such as the key bed 3 and the leg block 4 because the solenoid accommodating portion 100*b* is formed so as to be continuous to the solenoid accommodating portion 100*a*. As shown in FIG. 2, the circuit-board accommodating portion 200*a* is located at a height position lower than the lower surface 3D of the key bed 3 while the solenoid accommodating portion 100*a* is located at a height position higher than the lower surface 3D of the key bed 3. As shown in FIG. 3, the solenoid accommodating portion 100*b* is located at a height position higher than the lower surface 3D of the key bed 3. Accordingly, where a dimension in the vertical direction of each of the solenoid accommodating portions 100*a*, 100*b* is represented as $l_1$ and a dimension in the vertical direction of the circuit-board accommodating portion 200*a* is represented as $l_2$, a sum ($=l_1+l_2$) of the respective dimensions in the vertical direction of the solenoid accommodating portion 100*a* and the circuit-board accommodating portion 200*a*, (i.e., a dimension in the vertical direction of the one accommodating body which accommodates the solenoids and the circuit board, namely, the dimension in the vertical direction of the second portion), is larger than the dimension in the vertical direction of the solenoid accommodating portion 100*b*. Further, a dimension in a horizontal short-side direction of the solenoid accommodating portion 100*b* is made equal to $l_3$, as shown in FIG. 7. Here, the horizontal short-side direction is a direction which is perpendicular to a longitudinal direction of each drive unit 10-L, 10U that will be explained (the longitudinal direction being the same as the key arrangement direction) and which is parallel to the horizontal plane. As shown in FIG. 8, a dimension in the horizontal short-side direction of the circuit-board accommodating portion 200*a* is made equal to $l_5$. The dimension $l_3$ and the dimension $l_5$ are suitably determined depending upon the size of the solenoid accommodated in the solenoid accommodating portion 100*b* and the size of the circuit board 210 accommodated in the circuit-board accommodating portion 200*a*. In the embodiment, the dimension $l_3$ and the dimension $l_5$ are mutually different. In the embodiment, the circuit-board accommodating portion 200*a* is disposed such that a part of the circuit-board accommodating portion 200*a* extends frontward of the front end face of the solenoid accommodating portion 100*a*, as shown in FIG. 8. The arrangement takes account of workability in connecting the wires that extend from the circuit board 210 to the respective solenoids. More specifically, the solenoid accommodating portion 100*a* and the circuit-board accommodating portion 200*a* are disposed such that the solenoids are located right above respective connectors (not shown) of the circuit board 210. As a consequence, the part of the circuit-board accommodating portion 200*a* extends frontward of the front end face of the solenoid accommodating portion 100*a*. The solenoid accommodating portion 100*a* and the circuit-board accommodating portion 200*a* may be otherwise disposed. For instance, the structure of the circuit board 210 may be modified such that the positions of the connectors are changed, for instance, whereby the solenoid accommodating portion 100*a* can be disposed right above the circuit-board accommodating portion 200*a* and the dimension $l_3$ and the dimension $l_5$ can be made equal to each other.

FIG. 4 is a view for explaining a positional relationship among the key bed 3, the leg blocks 4, and the key drive device 10 when viewed from the front side of the automatic player piano 1 in the embodiment of the invention. The key drive device 10 includes: a drive unit 10-L configured to drive the keys 20 on a low-pitch side; a drive unit 10-U configured to drive the keys 20 on a high-pitch side; and a connecting portion 300 connecting the drive unit 10-L and the drive unit 10-U. Each of the drive units 10-L, 10-U has an elongated shape in the key arrangement direction in which the keys 20 of the keyboard 2 are arranged and has a solenoid accommodating portion 100*c* (as a third portion), in addition to the solenoid accommodating portions 100*a*, 100*b* indicated above. As described above, the circuit-board accommodating portion 200*a* exists below the solenoid accommodating portion 100*a*, but the circuit-board accommodating portion 200*a* does not exist below the solenoid accommodating portions 100*b*, 100*c*. While a plurality of holes through which air can pass are formed in the side surfaces of the circuit-board accommodating portion 200*a*, such holes may not be formed. As shown in FIG. 4, the circuit-board accommodating portions 200*a* of the respective drive units 10-L, 10-U are interposed between the pair of leg blocks 4 which are disposed on one and the other of left-side portion and the right-side portion of the automatic player piano 1 when viewed from the front side (i.e., between inner side surfaces 4*a* of the respective leg blocks 4). In a state in which the two drive units 10-L, 10-U are connected to each other, the solenoid accommodating portion 100*c* is located between the solenoid accommodating portions 100*a* of the respective drive units 10-L, 10-U in the key arrangement direction in which the keys 20 of the keyboard 2 are arranged, and is accommodated in the space 30*a*.

Like the solenoid accommodating portion 100*b*, the solenoid accommodating portion 100*c* is formed so as to be continuous to the solenoid accommodating portion 100*a* in the key arrangement direction and is disposed at the same height position as the solenoid accommodating portion 100*a* in the vertical direction. The solenoid accommodating portion 100*c* is configured such that a connecting portion 300 is attachable thereto for connecting adjacent drive units. In the embodiment, the solenoid accommodating portion 100*c* has, at its lower portion, screw holes (not shown) into which screws are inserted to secure the connecting portion 300 to the solenoid accommodating portion 100*c*.

As shown in FIG. 4, a pedal lever 80 is disposed below the solenoid accommodating portion 100*c*. The pedal lever 80 is configured to operate together with the pedal 8 when the pedal 8 is depressed, so as to transmit the operation to the action mechanism 6. The pedal lever 80 is fixed to the lower surface 3D of the key bed 3. Because the pedal lever 80 exists below the solenoid accommodating portion 100*c*, a dimension of the solenoid accommodating portion 100*c* as measured in the vertical direction is made smaller than the sum of the respective dimensions of the solenoid accommodating portion 100*a* and the circuit-board accommodating portion 200*a* as measured in the vertical direction and is made substantially equal to the dimension of the solenoid accommodating portion 100*b* as measured in the vertical direction.

Hereinafter, the solenoid accommodating portions 100*a*, 100*b*, 100*c* are collectively referred to as the solenoid accommodating portion 100 where appropriate. Subsequently, the structure of the key drive device 10 will be explained.

[Structure of Key Drive Device 10]

Figure 5A:
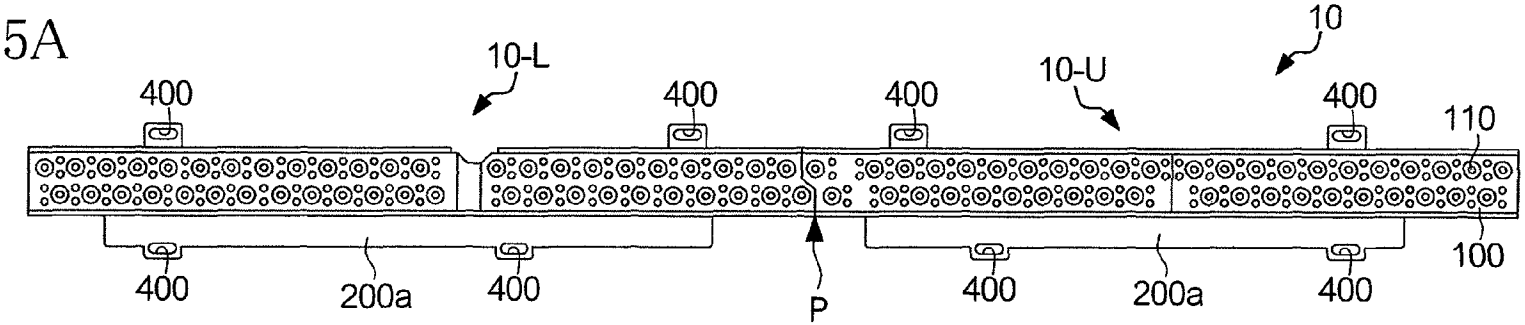
FIG. 5 is a view for explaining a structure of the key drive device in the embodiment of the invention.
Figure 5B:
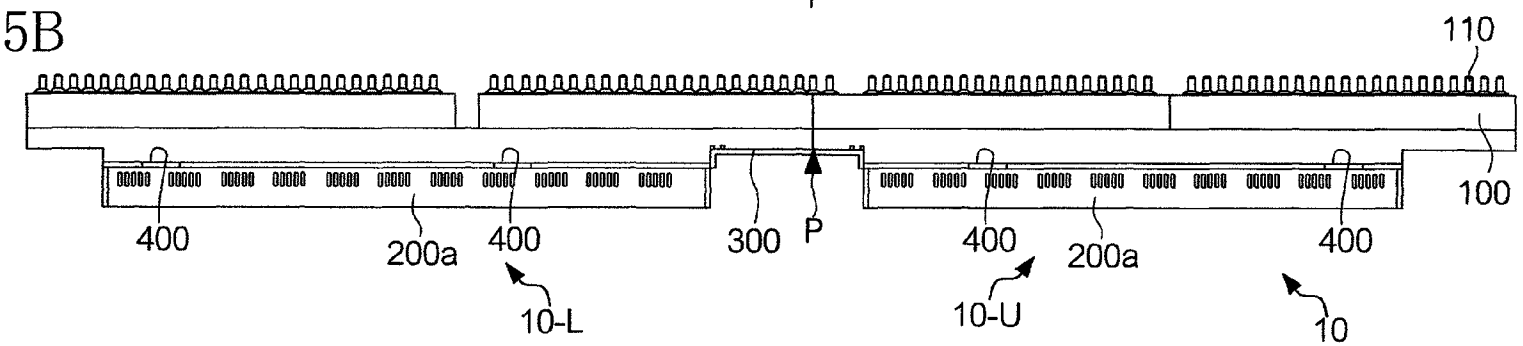

FIG. 5 is a view for explaining the structure of the key drive device 10 according to the embodiment of the present invention. FIG. 5A shows the key drive device 10 when viewed from above. FIG. 5B shows the key drive device 10 when viewed from the front side of the automatic player piano 1, namely, when viewed in the same direction as in FIG. 4. The key drive device 10 has opening portions 400 formed on an upper-surface side of the circuit-board accommodating portion 200*a* (nearer to the solenoid accommodating portion 100). The opening portions 400 are used when the key drive device 10 is connected and fixed to the key bed 3 by screwing. Further, on an upper-surface side of the solenoid accommodating portion 100, a top end portion of a plunger head 110 of each of the solenoids 101 (FIGS. 7 and 8) for giving a drive force to the associated keys 20 protrudes. In the present embodiment, eighty eight solenoids 101 are accommodated in the solenoid accommodating portion 100 so as to correspond to the respective keys 20. Accordingly, eighty eight plunger heads 110 protrude. The solenoid accommodating portion 100 has a shape that is elongated in one direction such that the solenoids 101 are accommodated so as to be arranged in two rows along the key arrangement direction. As shown in FIG. 5A, the opening portions 400 are formed at a plurality of locations on the front side and the rear side of the key drive device 10 within a range in which the solenoid accommodating portions 100*a* and the circuit-board accommodating portions 200*a* extend in the key arrangement direction. The opening portions 400 are not formed in a range in which each of the solenoid accommodating portions 100*b*, 100*c* extends.

As described above, the key drive device 10 includes the drive units 10-L, 10-R connected by the connecting portion 300. The drive unit 10-L and the drive unit 10-U are separable or detachable from each other at respective boundary portions P by removing the connecting portion 300.

Figures 6A, 6B:
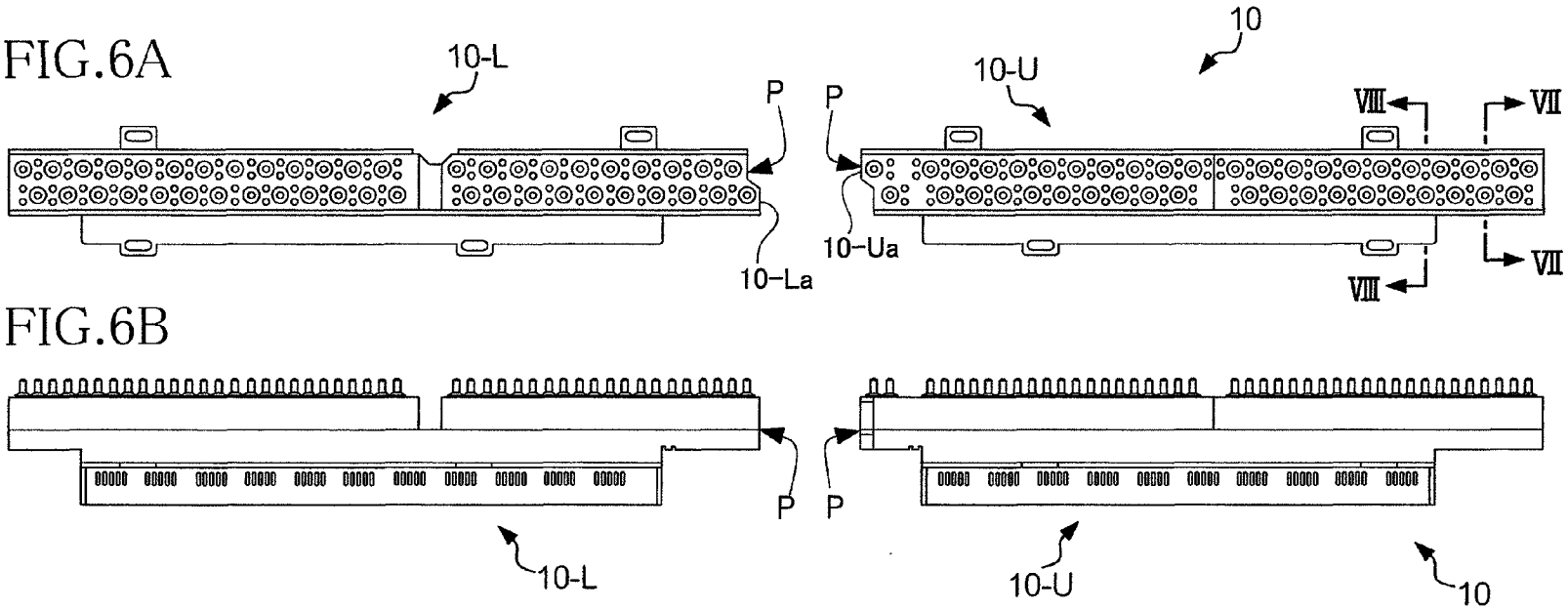
FIG. 6 is a view for explaining a structure of the key drive device in the embodiment of the invention when divided into drive units.

FIG. 6 is a view for explaining the structure of the key drive device 10 in the embodiment of the invention when divided into the drive units. FIG. 6A shows the key drive device 10 when viewed from above. FIG. 6B shows the key drive device 10 when viewed from the front side of the automatic player piano 1, namely, when viewed in the same direction as in FIG. 4. As shown in FIG. 6, the key drive device 10 is configured such that the drive unit 10-L and the drive unit 10-U are separable or detachable from each other at the respective boundary portions P when the connecting portion 300 is removed. Each of the boundary portions P of the respective drive units 10-L, 10-U has a stepped shape when viewed from above, depending upon the layout of the plunger heads 110 (the solenoids 101). More specifically, as shown in FIG. 6A, the drive unit 10-L has, at one end thereof nearer to the drive unit 10-U, a protruding portion 10-La formed on the front side. Similarly, the drive unit 10-U has, at one end thereof nearer to the drive unit 10-L, a protruding portion 10-Ua formed on the rear side. In a state in which the drive units 10-L, 10-U are connected by the connecting portion 300, the tip of the protruding portion 10-La is held in abutting contact with the drive unit 10-U while the tip of the protruding portion 10-Ua is held in abutting contact with the drive unit 10-L. Further, the side surface of the protruding portion 10-La and the side surface of the protruding portion 10-Ua are held in abutting contact with each other. Accordingly, when the drive unit 10-L and the drive unit 10-U are connected to each other, the two drive units 10-L, 10-U are positioned relative to each other in the horizontal direction.

FIG. 7 is a cross-sectional view of the key drive device 10 when viewed along arrows VII-VII in FIG. 6. As described above, the solenoids 101 are accommodated in the solenoid accommodating portion 100*b*. Each of the solenoids 101 has a plunger 120 and a coil 130. To the top end of each plunger 120, the plunger head 110 is attached. The plunger 120 of each solenoid 101 moves upward by an electric current supplied to the coil 130, thereby pushing up the rear end portion of the corresponding key 20 via the plunger head 110. The solenoid accommodating portion 100*c* has the same internal structure as the solenoid accommodating portion 100*b*.

FIG. 8 is a cross-sectional view of the key drive device 10 when viewed along arrows VIII-VIII in FIG. 6. Like the solenoid accommodating portion 100*b*, the solenoid accommodating portion 100*a* accommodates the solenoids 101. In the circuit-board accommodating portion 200*a*, the circuit board 210 having the control circuit is accommodated. The control circuit is configured to actuate the plungers 120 by supplying the electric current to the coils 130 of the solenoids 101, on the basis of the control signals outputted from the controller 11. The control circuit of the circuit board 210 is configured to supply the electric current not only to the coils 130 of the solenoids 101 accommodated in the solenoid accommodating portion 100*a*, but also to the coils 130 of the solenoids 101 accommodated in the solenoid accommodating portions 100*b*, 100*c*. While there are not illustrated, in the drawings, wires through which the electric current is supplied from the circuit board 210 to the coils 130 of the solenoids 101, the wires are disposed so as to extend from the circuit board 210 to the respective coils accommodated in the solenoid accommodating portions 100*b*, 100*c* through the solenoid accommodating portion 100*a*. In the embodiment, the circuit board 210 is composed of a single layer. The circuit board 210 may be composed of a plurality of layers. As described above, the key drive device 10 is fixed to the lower surface 3D of the key bed 3 by the screws 15 which are inserted through the respective opening portions 400 from below, so that the solenoid accommodating portion 100*a* is located at a height position higher than the lower surface 3D of the key bed 3 while the circuit-board accommodating portion 200*a* is located at a height position lower than the lower surface 3D of the key bed 3. The solenoid accommodating portion 100*b* shown in FIG. 7 and the solenoid accommodating portion 100*c* are located at the same height position as the solenoid accommodating portion 100*a* shown in FIG. 8, so that each of the solenoid accommodating portions 100*b*, 100*c* is located at the height position higher than the lower surface 3D of the key bed 3.

[Installation Example of Key Drive Device 10]

Figure 10:
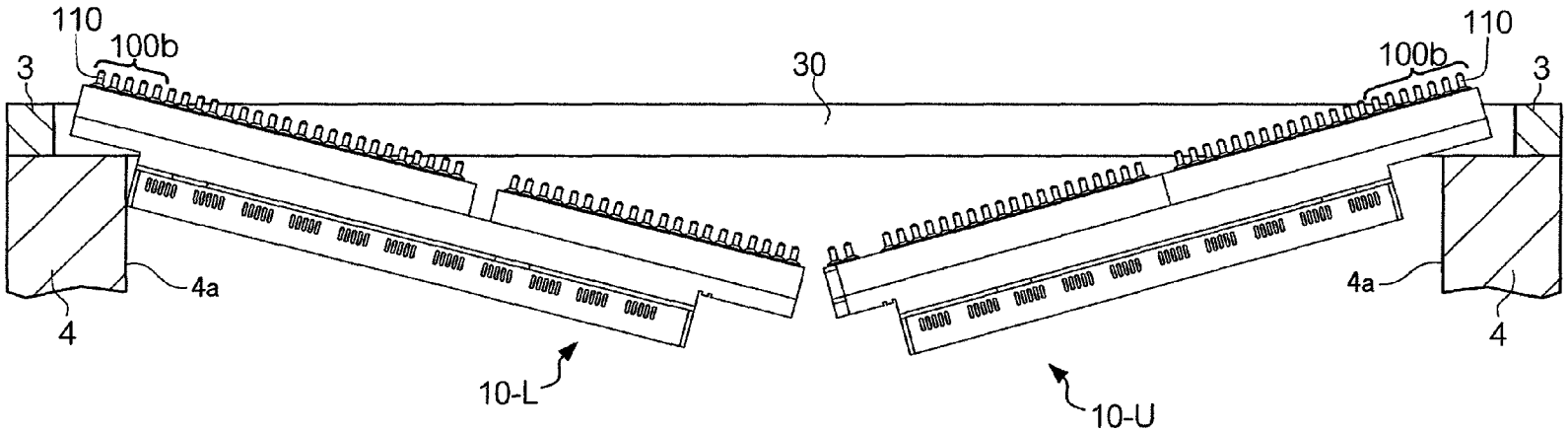
FIG. 10 is a view for explaining, subsequent to FIG. 9, the example in which the key drive device of the embodiment of the invention is installed on the grand piano.
Figure 11:
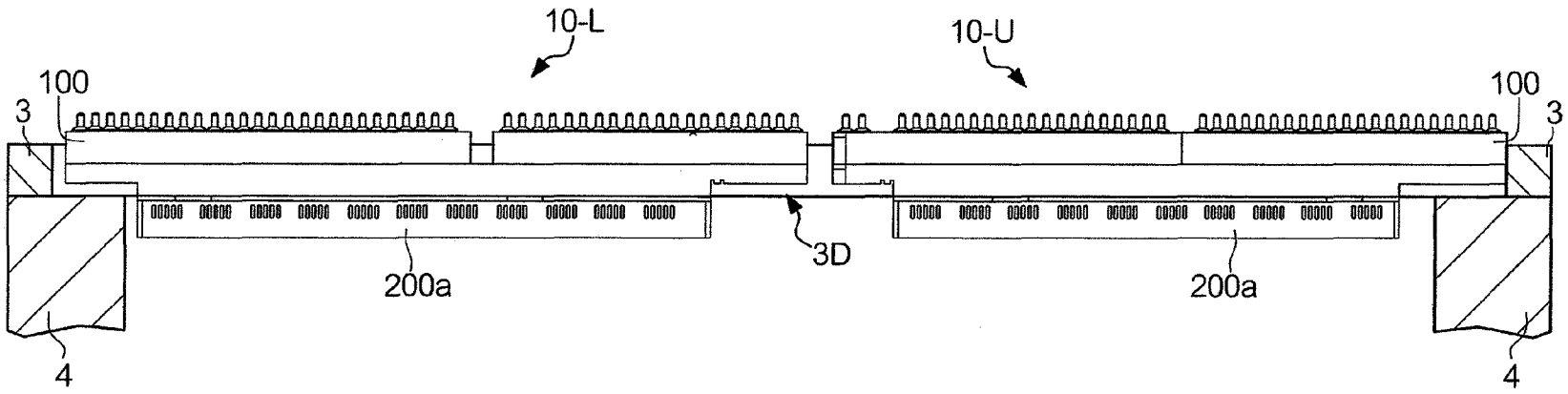
FIG. 11 is a view for explaining, subsequent to FIG. 10, the example in which the key drive device of the embodiment of the invention is installed on the grand piano.

The automatic player piano 1 is constituted such that the key drive device 10 is installed on a grand piano. Referring to FIGS. 9-11, there will be explained an example of installing the key drive device 10 on an ordinary grand piano.

FIG. 9 is a view for explaining the example of installing the key drive device 10 according to the embodiment of the present invention on the grand piano. FIG. 9 shows a positional relationship between the key bed 3 and the leg blocks 4 when viewed from the front side of the grand piano. In the key bed 3 of a grand piano on which the key drive device 10 has never been installed, the space 30 does not exist. Accordingly, a worker carries out, on the key bed 3, a working operation such as cutting so as to penetrate the key bed 3 in the vertical direction, thereby forming the space 30 as shown in FIG. 9. The space 30 has a generally rectangular parallelepiped shape as described above and has a size that permits the solenoid accommodating portion 100 of the key drive device 10 to be inserted thereinto. Opposite ends of the space 30 in the key arrangement direction are configured to extend outwardly of the corresponding outermost keys 20 of the keyboard 2 in the key arrangement direction. In this respect, portions of the space 30 formed in the key bed 3, which portions (i.e., the spaces 30*b*) are located above the respective leg blocks 4, may be formed after the leg blocks 4 have been once removed from the key bed 3. In this state, the pedal lever 80 has been removed from the key bed 3.

In a state in which the space 30 is thus formed, the worker installs the key drive device 10 on the grand piano.

FIG. 10 is a view for explaining, subsequent to FIG. 9, the installation example of the key drive device 10 of the embodiment of the invention on the grand piano. As shown in FIG. 10, after the key bed 3 has been fixed onto the leg blocks 4 and the keyboard 2 (not shown in FIG. 10) has been disposed on the key bed 3, the key drive device 10 in a state in which the key drive device 10 is divided in the drive units 10-L, 10-U is inserted into the space 30. In this instance, the solenoid accommodating portions 100*b* of the respective drive units 10-L, 10-U are initially inserted into the corresponding spaces 30*b* of the space 30 while the drive units 10-L, 10-U are inclined with respect to the horizontal plane. A sum of the overall length of the solenoid accommodating portion 100 of the drive unit 10-L in the longitudinal direction and the overall length of the solenoid accommodating portion 100 of the drive unit 10-U in the longitudinal direction is larger than the length of the space 30*a* in the longitudinal direction (i.e., the distance between the inner side surfaces 4*a* of the leg blocks 4 disposed on opposite sides of the space 30*a* in the longitudinal direction). Therefore, it is required for the worker to insert such that the drive units 10-L, 10-U are inclined. While not illustrated in FIG. 10, the keys 20 exist over the key bed 3, namely, over the space 30, as shown in FIG. 3. Therefore, the drive units 10-L, 10-U are inserted while adjusting an inclination amount of the drive units 10-L, 10-U to such an extent that the plunger heads 110 do not come into contact with the keys 20.

FIG. 11 is a view for explaining, subsequent to FIG. 10, the installation example of the key drive device 10 on the grand piano. FIG. 11 shows a state in which the drive units 10-L, 10-U are moved so as to be held in a horizontal posture from the state shown in FIG. 10 and in which portions of the upper surface of the circuit-board accommodating portion 200*a* of each of the drive units 10-L, 10-U where the opening portions 400 are formed are held in contact with the lower surface 3D of the key bed 3. In this state, the drive unit 10-L and the drive unit 10-U are separated from each other.

In the state described above, the worker electrically connects the circuit board 210 of the drive unit 10-L and the circuit board 210 of the drive unit 10-U, before the drive units 10-L, 10U are moved close to each other and are brought into contact with each other. In the example, each of the drive units 10-L, 10-U has a cable (not shown) by which the circuit board 210 of each drive unit is electrically connected to the circuit board 210 of the adjacent drive unit. In each of the drive units 10-L, 10-U, the cable extends through the solenoid accommodating portion 100*c* and can be pulled out from the boundary portion P outside the solenoid accommodating portion 100. When connectors provided at the tips of the respective cables are connected to each other, the circuit board 210 of the drive unit 10-U and the circuit board 210 of the drive unit 10-L are electrically connected.

Figure 12:
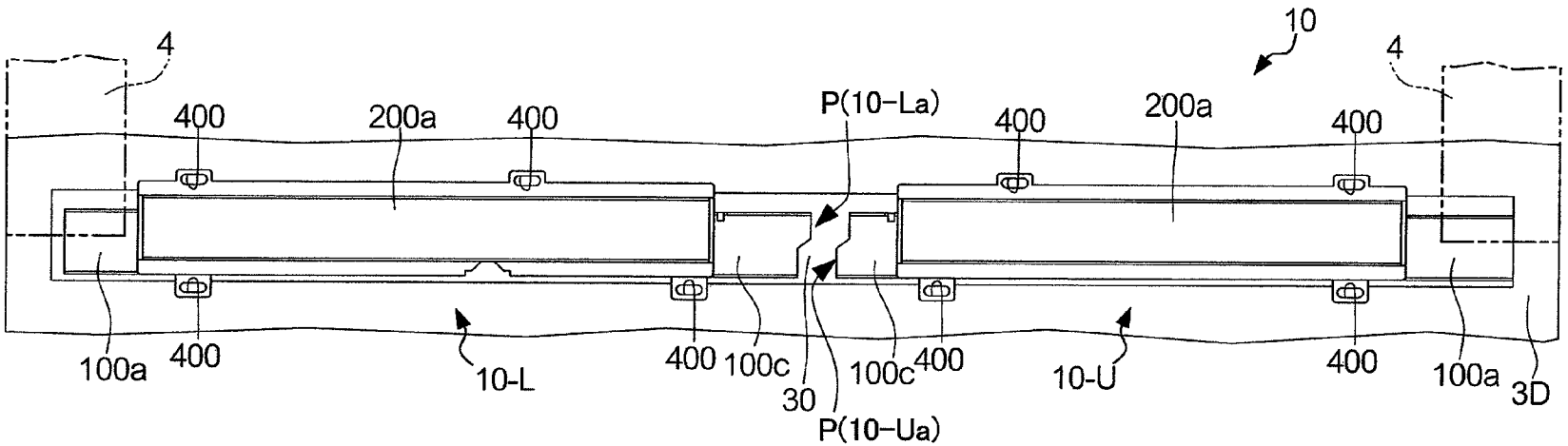
FIG. 12 is a view showing a relationship between the key drive device shown in FIG. 11 and the key bed when viewed from below.

FIG. 12 is a view showing a relationship between the key drive device 10 shown in FIG. 11 and the key bed 3 when viewed from below. Since FIG. 12 is a view when viewed from below, the lower surface 3D of the key bed 3 is seen except for portions thereof corresponding to the leg blocks 4. From the state shown in FIG. 12, the worker moves the drive unit 10-L and the drive unit 10-U toward each other, so as to bring the boundary portions P of the respective drive units 10-L, 10-U into contact with each other. In this state, the connecting portion 300 is attached. More specifically, the tip of the protruding portion 10-La of the drive unit 10-L is brought into contact with the drive unit 10-U while the tip of the protruding portion 10-Ua of the drive unit 10-U is brought into contact with the drive unit 10-L. Further, the side surface of the protruding portion 10-La and the side surface of the protruding portion 10-Ua are brought into contact with each other. On this occasion, since each of the boundary portions P of the respective drive units has a stepped shape, the two drive units 10-L, 10-U can be easily positioned relative to each other in the horizontal direction. Further, the upper surfaces of the circuit-board accommodating portions 200*a* of the respective drive units 10-L, 10-U come into contact with the lower surface 3D of the key bed 3, and the connecting portion 300 attached to the lower portion of the solenoid accommodating portion 100*c* further facilitates positioning of the two drive units 10-L, 10-U in the horizontal direction and also facilitates positioning of the two drive units 10-L, 10-U in the vertical direction. The connecting portion 300 can be utilized as a cover for the cables and the connectors by which the adjacent drive units are connected. The circuit board 210 of the drive unit 10-U and the circuit board 210 of the drive unit 10-L may be electrically connected through the attached connecting portion 300, instead of using the connectors described above.

The key drive device 10 constructed as described above is fixed to the key bed 3 by inserting the screws 15 (FIG. 2) into the respective opening portions 400, so as to be screwed to the key bed 3. When the key drive device 10 is fixed to the key bed 3, a distance between the top ends of the plunger heads 110 and the associated keys may be adjusted.

When the key drive device 10 is fixed to the key bed 3 by the screws 15, the key drive device 10 may be provisionally fixed in a state in which the drive unit 10-L and the drive unit 10-U are separated from each other. This is because each opening portion 400 has a shape that is elongated in a direction in which the drive unit 10-L and the drive unit 10-U are moved when the two drive units 10-L, 10-U are brought into contact with each other, namely, in the key arrangement direction, so that the two drive units 10-L, 10-U can be moved so as to be brought into contact with each other even if the two drive units 10-L, 10-U have been provisionally fixed by screwing prior to the movement toward each other. Instead of screwing, in a state in which the portions of the respective drive units 10-L, 10-U which have been inserted into the respective spaces 30*b* are supported by the corresponding leg blocks 4, the drive unit 10-L and the drive unit 10-U may be connected by the connecting portion 300 and may be thereafter fixed to the key bed 3.

After the key drive device 10 has been fixed to the key bed 3, the pedal lever 80 is attached to the lower portion of the solenoid accommodating portion 100*c* via the key bed 3. This state is illustrated in FIG. 4. Further, the controller 11 and other components are attached to the grand piano, so that the automatic player piano 1 according to the present invention is constituted.

Where a maintenance operation or the like of the key drive device 10 is performed by detaching the key drive device 10 from the automatic player piano 1, the worker may conduct the procedure described above in a reverse order and may again attach the key drive device 10 on which the maintenance operation has been performed, according to the procedure described above. Where the space 30 has been already formed in the key bed 3, the key drive device 10 can be attachable to and detachable from the automatic player piano 1 without a need of removing the leg blocks 4 from the key bed 3.

Thus, the key drive device 10 does not have, at portions thereof corresponding to the spaces 30*b*, i.e., at the solenoid accommodating portions 100*b*, the structure corresponding to the circuit-board accommodating portion 200*a*, whereby the portions corresponding to the spaces 30*b* (the solenoid accommodating portions 100*b*) do not protrude downwardly from the lower surface 3D of the key bed 3. Further, the key drive device 10 is configured to be dividable into the plurality of drive units. Accordingly, when the key drive device 10 is installed on the grand piano, the solenoid accommodating portions 100*b* of the respective drive units are initially inserted into the corresponding spaces 30*b* with the drive units separated or divided, and subsequently the drive units are connected to each other. Therefore, even where the key drive device 10 is installed on the grand piano in which the keys 20 are located above the leg blocks 4, it is possible to maintain the shape of the leg blocks 4 without a need of partially removing the leg blocks 4 by cutting. Moreover, the key drive device 10 does not have, below the solenoid accommodating portion 100*c*, the structure corresponding to the circuit-board accommodating portion 200*a*, whereby there is no need of changing the position at which the pedal lever 80 is attached, to a more downward position. In other words, the attaching position of the pedal lever 80 after installation of the key drive device 10 does not change from that prior to installation of the key drive device 10. Even where there is a need to change, the change of the position can be made small.

Modified Embodiments

While one embodiment of the present invention has been illustrated above, the invention may be variously modified as described below.

Modified Embodiment 1

In the illustrated embodiment, the key drive device 10 does not have, below the solenoid accommodating portion 100*c* of the drive units 10-L, 10-U, the structure corresponding to the circuit-board accommodating portion 200*a* for the purpose of not largely changing the attaching position of the pedal lever 80 to a more downward position. In an instance where the position of the pedal lever 80 may be moved downward, the structure corresponding to the circuit-board accommodating portion 200*a* may exist below the solenoid accommodating portion 100*c*.

Figures 13A, 13B:
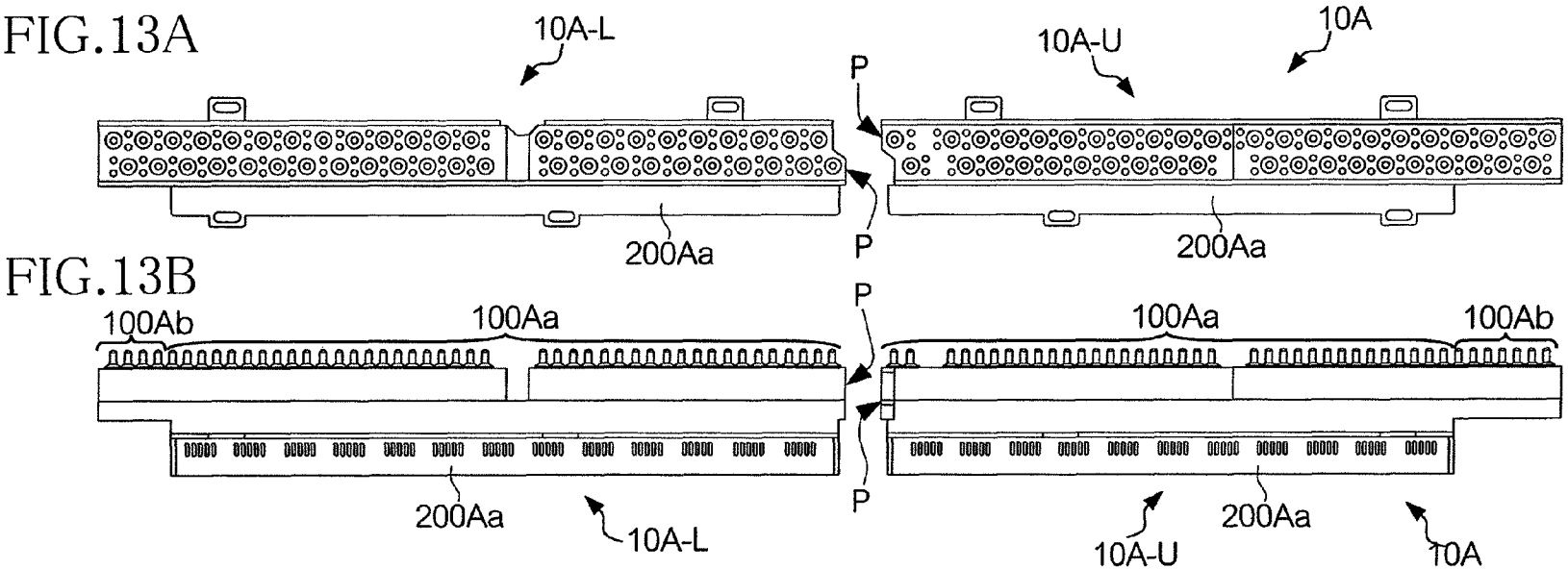
FIG. 13 is a view for explaining a structure of a key drive device in a modified embodiment 1 of the present invention.

FIG. 13 is a view for explaining a structure of a key drive device 10A in a modified embodiment 1 of the present invention. FIG. 13A is a view of the key drive device 10A when viewed from above while FIG. 13B is a view of the key drive device 10A when viewed from the front side of the automatic player piano, namely, when viewed in the same direction as in FIG. 4. The key drive device 10A of the modified embodiment 1 does not have the solenoid accommodating portion 100*c* which is provided in the key drive device 10 of the illustrated embodiment. In each of drive units 10A-L, 10A-U of the key drive device 10A, a solenoid accommodating portion 100Aa which has a circuit-board accommodating portion 200Aa at a lower portion thereof extends to the boundary portion P in the key arrangement direction. In this instance, the connecting portion 300 may be attached to a lower section of the circuit-board accommodating portion 200Aa. A solenoid accommodating portion 100Ab of the key drive device 10A is identical in construction with the solenoid accommodating portion 100*b* of the illustrated embodiment.

Modified Embodiment 2

In the illustrated embodiment, the circuit-board accommodating portion 200*a* protrudes downwardly from the lower surface 3D of the key bed 3. The circuit-board accommodating portion 200*a* may be configured so as not to protrude or so as to hardly protrude. Such a configuration will be explained with reference to FIGS. 14 and 15.

Figure 14A:
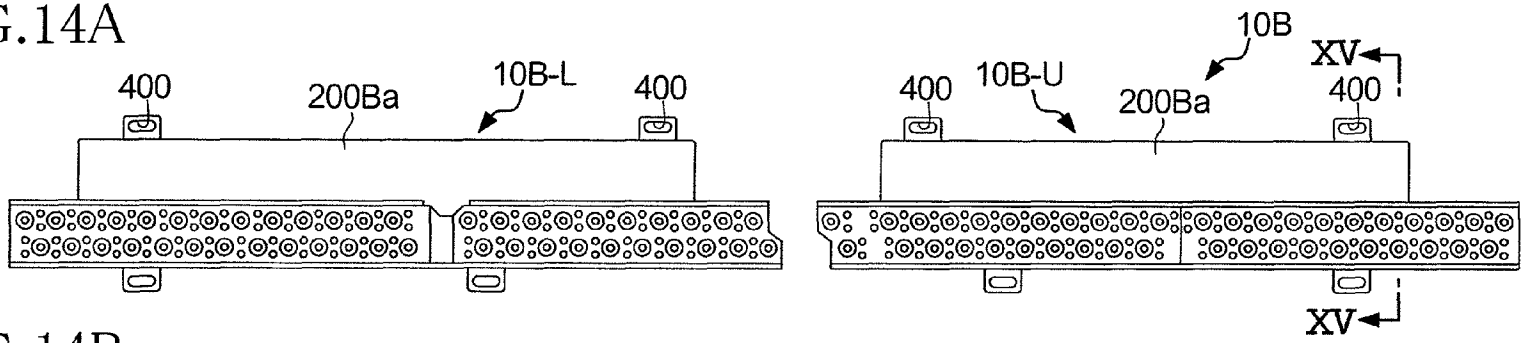
FIG. 14 is a view for explaining a structure of a key drive device in a modified embodiment 2 of the present invention.
Figure 14B:
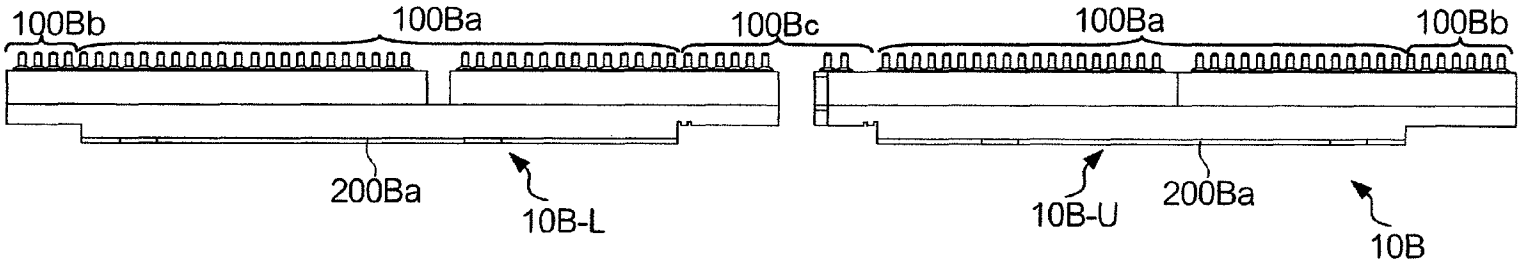
Figure 15:
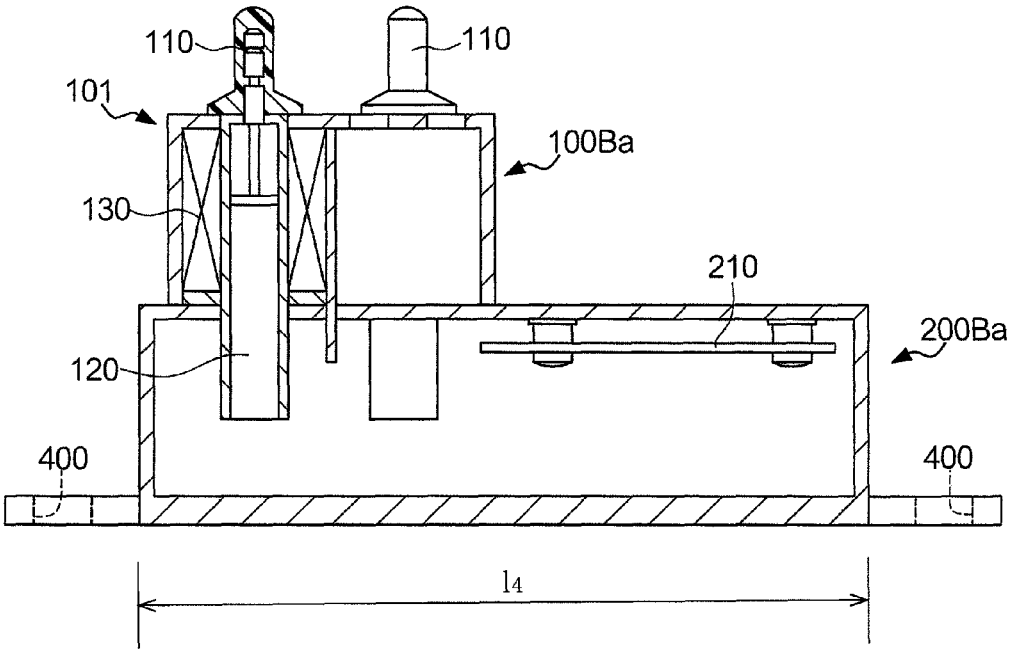
FIG. 15 is a cross-sectional view of the key drive device when viewed along arrows XV-XV in FIG. 14.

FIG. 14 is a view for explaining a structure of a key drive device 10B in a modified embodiment 2 of the present invention. FIG. 14A is a view of the key drive device 10B when viewed from above while FIG. 14B is a view of the key drive device 10B when viewed from the front side of the automatic player piano, namely, when viewed in the same direction as in FIG. 4. FIG. 15 is a cross-sectional view when viewed along arrows XV-XV in FIG. 14.

Unlike the circuit-board accommodating portion 200*a* which is provided below the solenoid accommodating portion 100*a* in each of the drive units 10-L, 10-U of the illustrated embodiment, a circuit-board accommodating portion 200Ba in each of drive units 10B-L, 10B-U of the modified embodiment 2 is provided so as to extend horizontally on one side of a solenoid accommodating portion 100Ba, in particular, in a short-side direction of each of the elongated drive units 10B-L, 10B-U (i.e., in the horizontal short-side direction of each of the drive units 10B-L, 10B-U). In the key drive device 10B of the modified embodiment 2, the solenoid accommodating portions 100Ba, solenoid accommodating portions 100Bb (each as the first portion), and a solenoid accommodating portion 100Bc are identical in construction with the solenoid accommodating portions 100*a*, the solenoid accommodating portions 100*b*, and the solenoid accommodating portion 100*c*, respectively, in the illustrated embodiment shown in FIGS. 3-7. In the modified embodiment 2, therefore, where the solenoid accommodating portion 100Ba and the circuit-board accommodating portion 200Ba in each drive unit 10B-L, 10B-U is regarded as one accommodating body (as the second portion) for accommodating the solenoids and the circuit board, a part of the accommodating body is accommodated in the space 30*a*. Further, a dimension 14 in the horizontal short-side direction of the solenoid accommodating portion 100Bb is made larger than the dimension in the horizontal short-side direction of the solenoid accommodating portion 100*b*. It is noted that the circuit-board accommodating portion 200Ba may be configured to extend in both of the vertical direction and the horizontal short-side direction depending upon the size of components to be accommodated therein.

The opening portions 400 to be in contact with the key bed 3 are formed at a lower portion of the circuit-board accommodating portion 200Ba of each drive unit 10B-L, 10B-U. Accordingly, in the key drive device 10B, not only the solenoid accommodating portions 100Ba, 100Bb, 100Bc, but also the circuit-board accommodating portion 200Ba of each drive unit 10B-L, 10B-U is inserted into the space 30 of the key bed 3. Like the space 30 in the illustrated embodiment, the space 30 of the key bed 3 in the modified embodiment 2 may have a rectangular parallelepiped shape and may have a larger volume than the space 30 in the illustrated embodiment. Alternatively, the space 30 may have a shape following the contour of the solenoid accommodating portions 100Ba, 100Bb, 100Bc and the circuit-board accommodating portions 200Ba.

Modified Embodiment 3

In the illustrated embodiment, the automatic player piano 1 is constituted such that the key drive device 10 is installed on the grand piano. The key drive device 10 may be installed on keyboard musical instruments, other than the grand piano, such as acoustic musical instruments including a harpsichord (cembalo) and an electronic piano. That is, as long as a keyboard musical instrument has a structure in which a part of the keyboard 2 is located above the leg block 4, any keyboard musical instrument can be constituted as the automatic player keyboard musical instrument by installing the key drive device 10. The "part of the keyboard 2" is not necessarily located at both of opposite ends of the keyboard 2 in the key arrangement direction. The "part of the keyboard 2" may be located only at one of the opposite ends of the keyboard 2 in the key arrangement direction. Further, the "part of the keyboard 2" may not necessarily include the key 20 for producing the highest tone or the key for producing the lowest tone. For example, there may be included an instance in which the leg block 4 is located below the third through the sixth keys 20 from the lowest-tone producing key.

Modified Embodiment 4

Figure 16:
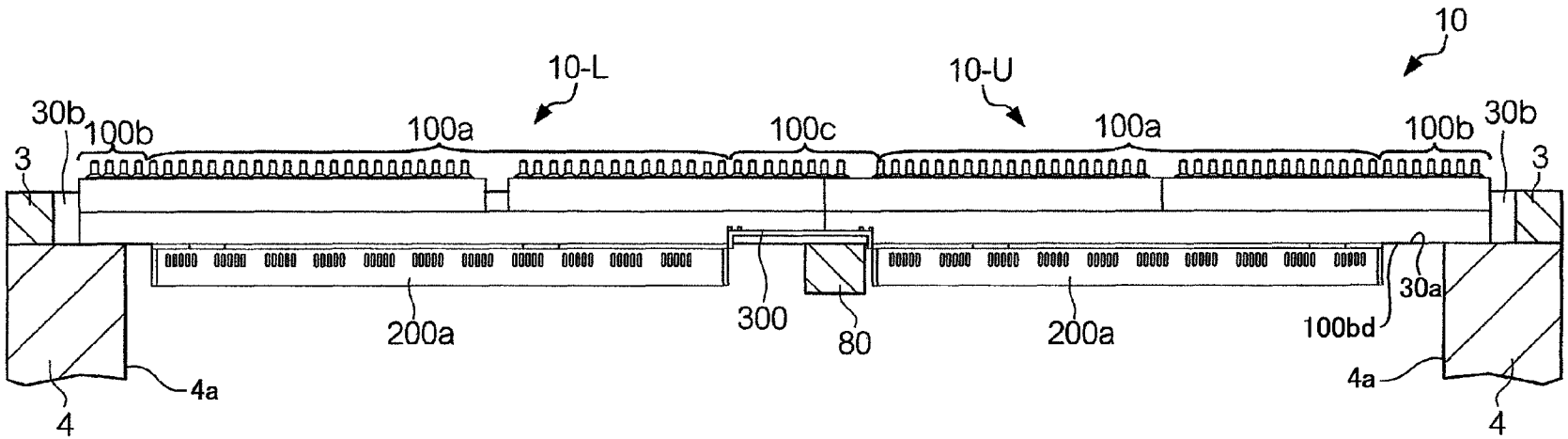
FIG. 16 is a view for explaining a structure of a key drive device in a modified embodiment 4 of the present invention.

In the illustrated embodiment, the solenoid accommodating portions 100*b* are not in contact with the leg blocks 4 in a state in which the key drive device 10 is installed on the grand piano. As a structure in which a lower section of the solenoid accommodating portion 100*b* in each drive unit 10-L, 10-U is partly in contact with the upper surface of the corresponding leg block 4, the leg block 4 may be configured to support the drive unit 10-L, 10-U. In this instance, the solenoid accommodating portion 100*b* may be enlarged to such an extent that a lower surface 100*bd* of the solenoid accommodating portion 100*b* comes into contact with the upper surface of the leg block 4, as shown in FIG. 16. In this arrangement, it is possible to distribute, to the leg blocks 4, a part of load that acts on the key bed 3 when the drive units 10-L, 10-U are fixed thereto. In this instance, the drive units 10-L, 10-U may be fixed not by being screwed to the key bed 3, but by a method which simply enables positioning of the drive units 10-L, 10-U such as a method using suitable fastening members or the like.

More specifically, in the illustrated embodiment, the drive units 10-L, 10-U are fixed to the key bed 3 by the screws 15, and the key bed 3 receives the weights and the reaction forces of the drive units 10-L, 10-U and at the same time, the key bed 3 supports the drive units 10-L, 10-U in a state in which the drive units 10-L, 10-U are positioned relative to each other in the front-and-rear direction and the left-and-right direction. In the modified embodiment 4, the leg blocks 4 receive the weights and the reaction forces of the drive units 10-L, 10-U. Accordingly, the drive units 10-L, 10-U may be installed on the grand piano in a state in which the drive units 10-L, 10-U are positioned relative to each other in the front-and-rear direction and the left-and-right direction by being fastened to the key bed 3 using the fastening members.

Modified Embodiment 5

In the illustrated embodiment, the key drive device 10 is divided into the two drive units. The key drive device 10 may be divided into three or more drive units. In such an instance, two of the three or more drive units which are located on one and the other of opposite ends of the key drive device 10 and each of which includes the solenoid(s) 101 for driving the associated key(s) 20 located on the corresponding leg block 4 may be configured as follows. That is, each of such two drive units may be configured to have the solenoid accommodating portion 100*b* which does not have, at its lower portion, the circuit-board accommodating portion 200*a* explained above with respect to the illustrated embodiment. Further, each of other drive units which are not located on the opposite ends of the key drive device 10 may be configured to be connectable, at opposite end portions thereof, to adjacent drive units and may be configured to have the structure corresponding to the circuit-board accommodating portion 200*a* at each of the opposite end portions. Where the key drive device 10 is divided into three or more drive units as described above, the drive units may be configured to be connected to each other via a control unit provided outside the drive units.

Modified Embodiment 6

In the illustrated embodiment, the drive unit 10-L and the drive unit 10-U that are adjacent to each other are connected by the connecting portion 300. The connecting portion 300 may not be necessarily utilized as long as the drive unit 10-L and the drive unit 10-U are fixed to the key bed 3 so as not to be separated from each other. Further, the structure corresponding to the connecting portion 300 may be provided in at least one of the drive unit 10-L and the drive unit 10-U.

Where key drive device 10 utilizes the connecting portion 300, the connecting portion 300 may have functions other than the function of connecting the drive units 10-L, 10-U. For instance, since the pedal lever 80 is located in the vicinity of the connecting portion 300, the connecting portion 300 may be configured such that a component for supporting the pedal lever 80 is attachable thereto or such that the component is already attached thereto. Further, the connecting portion 300 may have a structure corresponding to the controller 11.

Modified Embodiment 7

In the illustrated embodiment, like the circuit-board accommodating portion 200*a*, the solenoid accommodating portion 100 may be formed with holes or the like through which air for cooling can pass.

Modified Embodiment 8

In the illustrated embodiment, a portion of the key bed 3 around the space 30 may be reinforced by a reinforcing member such as a metal plate, thereby increasing the rigidity.

Modified Embodiment 9

In the illustrated embodiment, the pedal lever 80 is disposed in the vicinity of the boundary portions P of the respective drive units 10-L, 10-U. The boundary portions P may not be necessarily located in the vicinity of the pedal lever 80. Where the drive unit 10-L is longer than the drive unit 10-U, namely, where the drive unit 10-L has a dimension in the longitudinal direction larger than that of the drive unit 10-L, and the pedal lever 80 is disposed below the drive unit 10-L, the circuit-board accommodating portion 200*a* may not be provided below the solenoid accommodating portion 100 in the vicinity of the pedal lever 80.

While the embodiment and the modified embodiments of the present invention have been described in detail by reference to the accompanying drawings, it is to be understood that the present invention may be embodied with various other changes and modifications, which may occur to those skilled in the art, without departing from the spirit and scope of the invention defined in the appended claims.

What is claimed is:

1. A key drive device which is to be installed on a keyboard musical instrument configured such that a part of a keyboard is located above a leg block via a key bed and which is configured to drive a plurality of keys of the keyboard in accordance with control signals inputted to the key drive device, comprising:

a plurality of drive units each of which includes a plurality of actuators for respectively driving the plurality of keys and a control circuit for controlling operations of the plurality of actuators in accordance with the control signals and each of which is to be installed on the keyboard musical instrument such that at least a part of each of the drive units is inserted into a removal space formed by removing a part of the key bed so as to penetrate therethrough in a vertical direction, wherein, in a state in which the plurality of drive units are installed on the keyboard musical instrument, at least one of the drive units which drives at least one of the keys each of which is located above the leg block includes: (a) a first portion at least a part of which is inserted into an insertion space portion of the removal space defined by and between the leg block and the keyboard and which accommodates the actuators; and (b) a second portion at least a part of which is disposed in other space portion of the removal space except for the insertion space portion and which accommodates the actuators and the control circuit, a dimension of the second portion as measured in at least one of a vertical direction and a horizontal short-side direction being made larger than a dimension of the first portion as measured in the at least one of the vertical direction and the horizontal short-side direction.

2. The key drive device according to claim 1, wherein each of the plurality of drive units is long in a direction in which the plurality of keys of the keyboard are arranged, and wherein one of the drive units has the first portion at one of longitudinally opposite end portions thereof and is connected at the other of the longitudinally opposite end portions to another one of the drive units.

3. The key drive device according to claim 1, wherein the second portion has a dimension as measured in the vertical direction larger than a dimension of the first portion as measured in the vertical direction, such that, in the state in which the plurality of drive units are installed on the keyboard musical instrument, the second portion has a section that protrudes downwardly of the key bed.

4. The key drive device according to claim 1, wherein, in the state in which the plurality of drive units are installed on the keyboard musical instrument, the second portion has an upper portion which is located at a height position higher than a lower surface of the key bed and a lower portion at least a part of which is located at a height position lower than the lower surface of the key bed, and wherein the actuators are accommodated in the upper portion while the control circuit is accommodated in the lower portion.

5. The key drive device according to claim 1, wherein, in the state in which the plurality of drive units are installed on the keyboard musical instrument, the first portion is located only at a height position higher than a lower surface of the key bed.

6. The key drive device according to claim 4, wherein the keyboard musical instrument includes a pair of leg blocks each as the leg block, and wherein the lower portion of the second portion is disposed between the pair of leg blocks.

7. The key drive device according to claim 1, wherein, in the state in which the plurality of drive units are installed on the keyboard musical instrument, at least one of the drive units has, on one side thereof adjacent to another one of the drive units, a third portion in which the actuators are accommodated and which has a dimension as measured in the vertical direction smaller than a dimension of the second portion as measured in the vertical direction.

8. The key drive device according to claim 1, wherein, in the state in which the plurality of drive units are installed on the keyboard musical instrument, at least a part of the first portion is in contact with the leg block.

9. A keyboard musical instrument, comprising:

a leg block;

a keyboard a part of which is located above the leg block;

a key bed in at least a part of which a space is formed and which is disposed at a position below the keyboard and above the leg block; and the key drive device defined in claim 1, wherein the removal space into which the plurality of drive units of the key drive device are inserted is the space formed in the key bed.

10. A method of installing a key drive device on a keyboard musical instrument which is configured such that a part of a keyboard is located above a leg block via a key bed, wherein the key drive device is configured to drive a plurality of keys of the keyboard and comprises a plurality of drive units each of which includes a plurality of actuators for respectively driving the plurality of keys and a control circuit for controlling operations of the plurality of actuators in accordance with control signals, and wherein a removal space is formed by removing a part of the key bed so as to penetrate therethrough in a vertical direction, the method comprising the steps of:

inserting a part of at least one of the drive units into an insertion space of the removal space defined by and between the leg block and the keyboard, with at least two of the drive units separated from each other, electrically connecting the at least two separated drive units with the part of the at least one of the drive units inserted in the insertion space, and fixing the plurality of drive units to the key bed with the part of the at least one of the drive units inserted in the insertion space.

* * * * *